US010309647B2

(12) United States Patent
Taniguchi et al.

(10) Patent No.: US 10,309,647 B2
(45) Date of Patent: Jun. 4, 2019

(54) BIOMASS COMBUSTION BURNER, BIOMASS-MIXED FIRED BOILER, AND BIOMASS FUEL COMBUSTION METHOD

(71) Applicant: KAWASAKI JUKOGYO KABUSHIKI KAISHA, Kobe-shi, Hyogo-ken (JP)

(72) Inventors: Koji Taniguchi, Sakura (JP); Atsunori Kato, Kawasaki (JP); Suguru Yabara, Tokyo (JP); Yutaka Tanabe, Kasukabe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 441 days.

(21) Appl. No.: 14/368,917

(22) PCT Filed: Dec. 11, 2012

(86) PCT No.: PCT/JP2012/082101
§ 371 (c)(1),
(2) Date: Jun. 26, 2014

(87) PCT Pub. No.: WO2013/099593
PCT Pub. Date: Jul. 4, 2013

(65) Prior Publication Data

US 2014/0352582 A1 Dec. 4, 2014

(30) Foreign Application Priority Data

Dec. 26, 2011 (JP) ..... 2011-282803

(51) Int. Cl.
*F23D 1/00* (2006.01)
*F23G 7/10* (2006.01)
(Continued)

(52) U.S. Cl.
CPC ..... *F23G 5/033* (2013.01); *F23C 99/00* (2013.01); *F23D 1/00* (2013.01); *F23G 7/10* (2013.01);
(Continued)

(58) Field of Classification Search
None
See application file for complete search history.

(56) References Cited

U.S. PATENT DOCUMENTS 4,532,873 A * 8/1985 Rivers ..... F23D 1/02 110/224
4,850,288 A * 7/1989 Hoffert ..... F02C 3/26 110/214
(Continued)

FOREIGN PATENT DOCUMENTS

EP 1 416 221 A1 5/2004
EP 2 039 994 A2 3/2009
(Continued)

OTHER PUBLICATIONS

Aug. 7, 2015 Extended Search Report issued in European Patent Application No. 12862097.8.
(Continued)

*Primary Examiner* — David J Laux
(74) *Attorney, Agent, or Firm* — Oliff PLC

(57) ABSTRACT

The present invention provides a biomass combustion burner applied to a pulverized coal-fired boiler to burn biomass fuel, a biomass-mixed fired boiler that reduces an amount of CO2 derived from fossil fuels, and a method for burning biomass fuel using the foregoing. The biomass combustion burner includes a biomass fuel jet nozzle having a fuel jet port that jets biomass fuel conveyed by primary air; a secondary air nozzle having a secondary air jet port that surrounds the fuel jet port; and a tertiary air nozzle having
(Continued)

a tertiary air jet port that surrounds the secondary air jet port. The biomass fuel jet nozzle includes a fuel concentration adjusting section that changes a biomass fuel stream into a swirl flow to thereby make a fuel concentration higher on an outer circumferential portion side; and a degree-of-swirl adjusting plate that reduces a degree of swirl of a jetting fuel stream.

2 Claims, 5 Drawing Sheets

(51) Int. Cl.
*F23C 99/00* (2006.01)
*F23G 5/033* (2006.01)

(52) U.S. Cl.
CPC *F23C 2900/01001* (2013.01); *F23G 2201/80* (2013.01); *F23G 2205/20* (2013.01); *F23G 2209/26* (2013.01); *F23G 2209/261* (2013.01)

(56) References Cited

U.S. PATENT DOCUMENTS 4,887,962 A * 12/1989 Hasenack ..... F23D 14/78 110/263
5,630,368 A * 5/1997 Wagoner ..... F22B 7/12 110/105
7,213,522 B2 5/2007 Okazaki et al.
7,832,341 B2 * 11/2010 Walsh, Jr. ..... F23C 1/06 110/104 B
2009/0274985 A1 11/2009 Mcknight et al.
2010/0064986 A1 * 3/2010 Kiyama ..... F23D 1/00 122/16.1
2010/0275825 A1 * 11/2010 Bool, III ..... F23K 1/00 110/347
2011/0107948 A1 * 5/2011 Kurata ..... F23C 1/00 110/342

FOREIGN PATENT DOCUMENTS

EP 2 249 081 A1 11/2010
JP A-4-20702 1/1992
JP A-9-26112 1/1997
JP A-2005-140480 6/2005
JP A-2005-291524 10/2005
JP A-2005-291534 10/2005
JP A-2007-333232 12/2007
WO 97/47923 A1 12/1997

OTHER PUBLICATIONS

Nov. 4, 2014 Office Action issued in Chinese Application No. 201210574861.1.
International Search Report issued in International Application No. PCT/JP2012/082101 dated Mar. 5, 2013.
Written Opinion of the International Searching Authority issued in International Application No. PCT/JP2012/082101 dated Mar. 5, 2013.
Nov. 30, 2018 Office Action issued in Indian Patent Application No. 5271/DELNP/2014.

* cited by examiner

BIOMASS COMBUSTION BURNER, BIOMASS-MIXED FIRED BOILER, AND BIOMASS FUEL COMBUSTION METHOD

TECHNICAL FIELD

The present invention relates to a biomass combustion burner used in a coal-fired boiler that uses biomass fuel as auxiliary fuel, a biomass-mixed fired boiler including the biomass combustion burner, and a method for burning biomass fuel.

BACKGROUND ART

Recently, a need exists to promote planned performance of steps against global warming. Of the total greenhouse effect gases discharged in Japan, energy-derived CO2 emissions account for about 90% in recent years. Moreover, of the total power generated, coal-fired power generation discharges 50% CO2. Thus, coal-fired power generating facilities are required to promote the use of new types of energy having low environmental impact.

Against this background, the "Special Measures Law Concerning the Use of New Energy by Electric Utilities" (hereinafter, the "RPS (Renewables Portfolio Standard) Law") was enacted in Japan. The RPS Law is intended to promote the use of new energy by annually imposing an obligation on electricity retailers to use a predetermined amount or more of electricity derived from new energy or the like, according to the amount of electricity the retailers sell.

The RPS Law permits the electricity retailers to build a new coal-fired power generating facility only if the coal-fired power generating facility is a biomass-mixed system that burns biomass as auxiliary fuel. Existing facilities are also required to introduce the biomass-mixed combustion system.

Organic substances repeat a cycle of decomposition, absorption, and release on Earth. Equilibrium can thus be achieved for the amount of CO2 discharged by biomass energy by having a source of absorbing the equal amount of CO2. Biomass power generation that uses woody biomass fuel as a circulative resource therefore does not practically increase CO2 load in the atmosphere and thus carries the weight of expectations as new energy. Easily collectable woody biomass includes wood pellets and wood chips.

Additionally, use of the biomass fuel as auxiliary fuel in the coal-fired boiler not only saves fossil fuels and reduces the amount of CO2 emissions, but also achieves reduction in NOx contained in combustion exhaust gases because the biomass fuel contains low nitrogen content.

As a combination type coal-fired boiler that has hitherto been used, a known biomass-mixed fired boiler includes a conventional pulverized coal burner or a biomass-mixed combustion burner that supplies coal and biomass fuel simultaneously to thereby burn pulverized fuel that is a mixture of pulverized coal and biomass fuel. A typical system uses a conventional pulverized coal-fired boiler and manufactures a mixed fuel of pulverized coal and biomass by, for example, adding a woody biomass material to a roller or other type of mill that crushes coal into fine powder. The system then conveys the mixed fuel on conveyance air and burns the mixed fuel using the pulverized coal burner.

The roller mill pulverizes coal into fine particles of commonly 200 μm or less, preferably about 70 μm, in order to improve combustion efficiency of the burner. At this time, the biomass fuel is also pulverized into fine particles. If, in contrast, the coal and the woody biomass are loaded and processed simultaneously in the roller mill, an aggravated product grain size results with a resultant increase in the amount of coarse components of 100 μm or more. FIG. 7 compares a pulverized grain size distribution when 5% woody biomass is mixedly processed in the roller mill with that when only coal is processed. In the graph showing grain sizes of product fuels in FIG. 7, the abscissa represents sieve mesh in a logarithmic scale and the ordinate represents weight percentage of fuel that has passed through the sieve mesh. The graph reveals that mixing the woody biomass expands the grain size distribution of the product fuel both in coarse and fine directions.

In addition, the woody biomass fuel and the pulverized coal have combustion characteristics different from each other. For example, the woody biomass has a volatile content twice as high as that of coal. The wood pellet has a calorific value of ⅔ of that of coal and the wood chip has a calorific value of ½ of that of coal. The wood pellet and the wood chip have an ash content of 1/10 or less of that of coal. Thus, the mixing ratio is limited in co-firing the biomass fuel with coal in a burner designed as a pulverized coal burner.

The biomass fuel mixing ratio in the pulverized coal fired boiler is 3% in terms of actual industrial applications and the limit is estimated to be about 5%.

With future trends taken into consideration, if a mixed fuel burning ratio of about 30% by weight can be achieved in the biomass-mixed fired boiler that co-fires pulverized coal to which the woody biomass fuel is added as auxiliary fuel, possibility of utilization of the biomass-mixed fired boiler is expected to greatly increase. A high mixed fuel burning ratio of the biomass fuel cannot be obtained from using the pulverized coal burner and thus conceived is the introduction of a biomass combustion burner.

The finer the woody biomass is pulverized, the more the power is required in pulverization, which increases the unit requirement. On the other hand, the woody biomass fuel is easier to burn than coal if particle diameters are the same, which eliminates the need for making small the pulverized grain size. The woody biomass fuel and the pulverized coal have combustion characteristics different from each other. Thus, to burn the woody biomass fuel efficiently, ideally, the biomass combustion burner specifically designed for use with the woody biomass fuel is used.

To use a biomass combustion burner, a pulverizing mill is operated under conditions suitable for the woody biomass fuel independently of the pulverized coal. The biomass-mixed fired boiler can be operated with a suitable mixed fuel burning ratio selected as against the coal used in the pulverized coal burner.

The mixed fuel burning ratio for the boiler is determined according to the numbers of pulverized coal-fired burners and biomass combustion burners and the combustion efficiency.

Patent Document 1 discloses a biomass combustion burner that is applied to a biomass-mixed fired boiler that loads pulverized coal and woody biomass fuel through respective lines into a furnace for combustion. The disclosed biomass combustion burner includes a biomass fuel jet nozzle. The biomass fuel jet nozzle includes a disperser at a center thereof, the disperser preventing uneven flow of the biomass fuel, and a venturi disposed upstream inside the nozzle, the venturi increasing flow velocity of the fuel to thereby cause biomass fuel particles to collide with the disperser. The biomass fuel jet nozzle further includes a flame stabilizer disposed at a leading end thereof, the flame stabilizer having a stepped enlarging structure for sharply expanding the biomass fuel stream. The biomass combustion burner further includes a combustion air nozzle on the outside of the biomass fuel jet nozzle, the combustion air nozzle supplying a secondary air swirl flow.

The biomass combustion burner is optimized for burning a predetermined amount of biomass fuel. The number of biomass combustion burners to be installed may be determined according to the amount of biomass fuel to be processed required in the furnace to which the burners are applied. The arrangement disclosed in patent document 1 has a mixed fuel burning ratio of 15%.

It is noted that, preferably, the biomass combustion burner is disposed between a pulverized coal combustion burner and a two-stage combustion air jetting port.

Patent Document 2 discloses a boiler that includes a biomass-mixed combustion burner burning pulverized coal and biomass fuel and a boiler that includes a starting or auxiliary burner that functions also as a biomass fuel burning burner that burns biomass fuel supplied intermittently thereto. Patent Document 2 does not, however, describe any specific configuration of the biomass combustion burner, problems encountered during its use, solving means, and the like.

Patent Document 3 discloses a pulverized coal combustion burner. The disclosed burner is adapted to pulverized coal that has a greater calorific value, a greater amount of air required for combustion, and greater specific gravity than those of the biomass fuel and thus has a small optimum grain size. To burn the woody biomass fuel with high efficiency, therefore, the burner is required to be optimized to suit the woody biomass fuel.

PRIOR ART DOCUMENTS

Patent Documents

Patent Document 1: JP-A-2005-291534
Patent Document 2: JP-A-2005-291524
Patent Document 3: JP-A-H09-26112

DISCLOSURE OF THE INVENTION

An object is to provide a biomass combustion burner that co-fires biomass fuel in a pulverized coal-fired boiler to thereby enable combustion of a large amount of woody biomass, a biomass-mixed fired boiler capable of reducing an amount of CO2 derived from fossil fuels, and a method for burning biomass fuel using a biomass combustion burner.

To achieve the foregoing object, an aspect of the present invention provides a biomass combustion burner comprising a biomass fuel jet nozzle having a bent section and a fuel jet port that jets biomass fuel conveyed by primary air; a secondary air nozzle having a secondary air jet port that surrounds an opening in the fuel jet port, the secondary air nozzle jetting secondary air; and a tertiary air nozzle having a tertiary air jet port that surrounds an opening in the secondary air nozzle jet port, the tertiary air nozzle jetting a swirl flow of tertiary air.

In the biomass burning burner according to the aspect of the present invention, the biomass combustion burner includes a swirler disposed at a center inside the biomass fuel jet nozzle, the swirler changing a biomass fuel stream drifted by the bent section into an axially whirling swirl flow to thereby make a fuel concentration lower on a pipe axis side and higher on an outer circumferential portion side, and includes a degree-of-swirl adjusting plate disposed on a pipe inner wall immediately upstream of the fuel jet port, the degree-of-swirl adjusting plate reducing a degree of swirl of the fuel stream that jets from the fuel jet port, thereby optimizing a fuel concentration distribution, and an opening in the secondary air jet port and an opening in the tertiary air jet port are adjusted to reduce an amount of the secondary air and a buffer stream is thereby formed between the fuel stream and a tertiary air stream.

Preferably, the biomass combustion burner of the aspect of the present invention may include an oil supply pipe disposed in a straight pipe section downstream of the bent section of the biomass fuel jet nozzle, the oil supply pipe passing through a pipe axis to supply liquid fuel.

Independently of a pulverizing mill for pulverized coal, a secondary pulverizing mill, such as an impact type crusher (e.g. TSX Type Shredder manufactured by EarthTechnica Co., Ltd.), may be used to pulverize woody biomass material into biomass fuel having a particle diameter of 2 mm or under. The biomass fuel is conveyed by the primary air to serve as a fuel stream that is supplied to the biomass combustion burner of the aspect of the present invention, and burned in the furnace.

To reduce NOx emissions from the combustion gas in the furnace in which the biomass combustion burner is installed, preferably, the biomass fuel is burned in a reducing atmosphere.

The biomass combustion burner of the aspect of the present invention requires a flow velocity of about 15 to 25 m/s for conveyance of the biomass fuel, so that predetermined restrictions are imposed on the amount of primary air. Moreover, to efficiently burn the biomass fuel in the reducing atmosphere, preferably, the biomass combustion burner is operated such that the amount of primary air is 0.8 or more and 2.5 or less in terms of an A/C value ($Nm^3/kg$) relative to weight of the biomass fuel.

The biomass combustion burner of the aspect of the present invention can be operated at an A/C value of 2.5 or less with a rated fuel flow rate and an A/C value of 1.5 or less with a condition of load of 60% of the rating.

With a quantity of fuel of 60% or more of the rating, the biomass combustion burner can be operated such that a value of A/C is not greater than the proportional distribution between A/C 2.5 in a quantity of fuel of burner rating and A/C 1.5 in a quantity of fuel of 60% of the burner rating.

In the biomass combustion burner of the aspect of the present invention, a secondary air stream smaller than a tertiary air stream whirls the biomass fuel discharged into the furnace back in a nozzle axial direction to thereby create a vortex around the jet port. Flame holding performance is thereby improved and combustion in the reducing atmosphere is made to continue even a longer time, so that a NOx reduction effect can be enhanced.

A biomass-mixed fired boiler according to an aspect of the present invention comprises a pulverized coal-fired boiler including the biomass combustion burner of the aspect of the present invention, wherein biomass fuel processed by a pulverizing mill different from a pulverizing mill that processes pulverized coal is supplied to the biomass combustion burner.

The biomass combustion burner is disposed behind a furnace of the pulverized coal-fired boiler and on a level equal to, or even higher than, a pulverized coal burner disposed at a higher position. The biomass combustion burner may be disposed in front of the furnace of the pulverized coal fired boiler.

The biomass-mixed fired boiler according to the aspect of the present invention burns a large volume of biomass fuel to thereby save coal consumption and reduce the amount of CO2 emissions and NOx emissions.

A method for burning biomass fuel according to an aspect of the present invention burns biomass fuel by supplying the biomass combustion burner of the aspect of the present invention with a fuel stream that contains woody biomass fuel exhibiting a grain size distribution of 2 mm or under, the woody biomass fuel being conveyed by the primary air, the fuel stream having a flow velocity of from 15 m/s to 25 m/s, and by supplying the secondary air and the tertiary air such that combustion air has a value of A/C of 0.8 or greater and a value of A/C not greater than proportional distribution between A/C 2.5 in a quantity of fuel of burner rating and A/C 1.5 in a quantity of fuel of 60% of the burner rating.

The method for burning biomass fuel according to the aspect of the present invention enables a large volume of biomass fuel to be burned effectively by appropriately operating the biomass combustion burner according to the aspect of the present invention.

The biomass combustion burner according to the aspect of the present invention is capable of burning a large volume of biomass fuel independently of the pulverized coal.

An adequate number of biomass combustion burners may be installed relative to a new or existing pulverized coal-fired boiler to form a biomass-mixed fired boiler. The biomass-mixed fired boiler is adapted to burn the biomass fuel, which achieves a significant effect of reducing the amount of coal burned, the amount of NOx emissions from exhaust gases, and the amount of CO2 emissions derived from fossil fuels.

MODES FOR CARRYING OUT THE INVENTION

An embodiment of the present invention will be described below with reference to the accompanying drawings.

Figure 1:
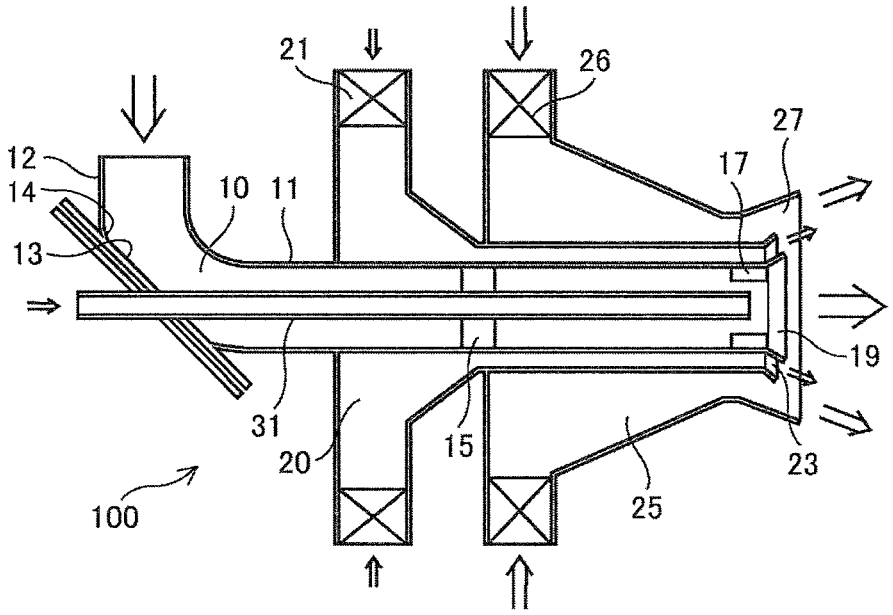
FIG. 1 is a schematic cross-sectional view showing a biomass combustion burner according to an embodiment of the present invention.
Figure 2A:
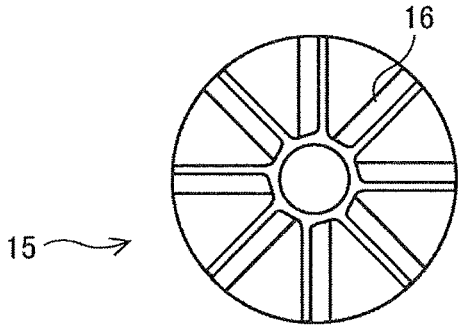
FIGS. 2A and 2B are illustrations showing exemplary swirlers included in the biomass combustion burner according to the embodiment.
Figure 2B:
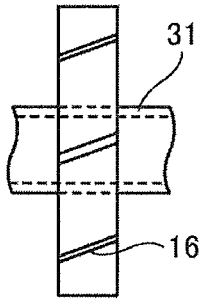

FIG. 1 is a schematic cross-sectional view showing a biomass combustion burner according to an embodiment of the present invention. FIGS. 2A and 2B are illustrations showing exemplary swirlers included in the biomass combustion burner, FIG. 2A being a front elevational view showing the swirlers as viewed from a pipe axis direction and FIG. 2B being a side elevational view showing the swirlers as viewed from a direction perpendicular to the pipe axis.

As shown in FIG. 1, this biomass combustion burner 100 according to the embodiment includes a biomass fuel jet nozzle 10, a secondary air nozzle 20, and a tertiary air nozzle 25. An auxiliary fuel supply pipe 31 may be disposed on the pipe axis of the biomass fuel jet nozzle 10.

The biomass fuel jet nozzle 10 supplies biomass fuel conveyed by primary air into a furnace. The primary air used here is supplied in such a quantity as to result in a wind velocity of about 15 to 25 m/s at which the biomass fuel does not stagnate in the pipe. In the biomass fuel jet nozzle 10, an introduction pipe 12 is made to meet a biomass fuel supply pipe 11 substantially perpendicularly at a position of a bent section 14. The biomass fuel supply pipe 11 is disposed to extend in a horizontal direction. The biomass fuel jet nozzle 10 causes a fuel stream that flows therein from the introduction pipe 12 to collide with a reversal plate 13 disposed at the bent section 14 and to thereby be bent substantially at 90°. When the fuel stream is smoothly bent by a bent pipe at the bent section 14, a centrifugal force causes fuel particles to unevenly reside on an outer circumferential side of the bent pipe, so that a fuel distribution inside the pipe becomes uneven circumferentially at an outlet of the bent pipe. Thus, the nozzle according to the embodiment of the present invention causes the fuel stream to collide with the flat reversal plate 13 to thereby disturb the stream, thereby making the fuel distribution inside the pipe uniform in the circumferential direction.

The biomass fuel stream conveyed by the primary air flows past the bent section 14. This causes concentration distribution of the biomass fuel to become uneven at a flow cross section. A fuel concentration adjusting section 15 is thus disposed downstream of the bent section 14 at a center inside the biomass fuel jet nozzle 11. The fuel concentration adjusting section 15 adjusts fuel concentration in the biomass fuel stream.

As shown in FIGS. 2A and 2B, the fuel concentration adjusting section 15 is configured to include a plurality of swirlers 16 disposed in a flow path of the biomass fuel jet nozzle 11. The swirlers 16 are each tilted relative to the pipe axis. The swirlers 16 change the biomass fuel stream into a swirl flow that whirls around the axis, thereby making the fuel concentration lower at the center and higher on the outer circumferential portion and making the concentration distribution substantially uniform in the circumferential direction.

At least one degree-of-swirl adjusting plate 17 is disposed on a pipe inner wall immediately upstream of a fuel jet port 19 that jets fuel into the furnace. This reduces a swirl force of the fuel stream given by the swirlers 16, thereby preventing the fuel stream from spreading after jetting. The at least one degree-of-swirl adjusting plate 17 comprises a plurality of flat plates disposed in the circumferential direction, each flat plate extending substantially in parallel with the pipe axis. A size and an orientation of the degree-of-swirl adjusting plates 17 may be appropriately determined according to the swirl force of the fuel stream and an angle of spread after jetting.

The secondary air nozzle 20 is disposed so as to surround the biomass fuel jet nozzle 10 and the tertiary air nozzle 25 is disposed so as to surround the secondary air nozzle 20.

The secondary air nozzle 20 draws secondary air in via a swirl vane 21 from a wind box and supplies the secondary air into the furnace from a secondary air jet port 23 formed to surround the fuel jet port 19. Similarly, the tertiary air nozzle 25 draws tertiary air in via a swirl vane 26 from a wind box and supplies the tertiary air into the furnace from a tertiary air jet port 27 formed to surround the secondary air jet port 23.

The secondary air and the tertiary air are mixed as part of combustion air with the biomass fuel stream spreading over the inside of the furnace from the fuel jet port 19 to thereby burn the biomass fuel.

The secondary air is present inside the tertiary air and contacts first the biomass fuel stream to bend the fuel stream inwardly. The secondary air thereby retards meeting of the fuel stream with the tertiary air and maintains a condition of a high fuel concentration. The secondary air thus achieves an action of ensuring steady ignition performance and improving flame holding performance. Additionally, combustion time with low oxygen is ensured, so that NOx emissions can be effectively reduced.

In the biomass combustion burner 100 shown in FIG. 1, the swirl vane 21 and the swirl vane 26 are disposed near respective intake ports from the wind box in order to form a combustion air swirl flow that whirls around the fuel jet port 19. The swirl vanes 21, 26 may still be disposed immediately upstream of the secondary air jet port 23 and the tertiary air jet port 27, respectively. It is noted that the secondary air has a weak action when the swirl is intensified and the arrangement may not include the swirl vane 21 for the secondary air.

The auxiliary fuel supply pipe 31 supplies liquid fuel or gas fuel for an auxiliary or starting use, used alternatively when, for example, there is a short supply of biomass fuel. Though effective for steady operation, the auxiliary fuel supply pipe 31 is not absolutely required.

Although not shown, a pilot burner and a flame detector are provided for the biomass combustion burner 100 according to the embodiment.

Figure 3:
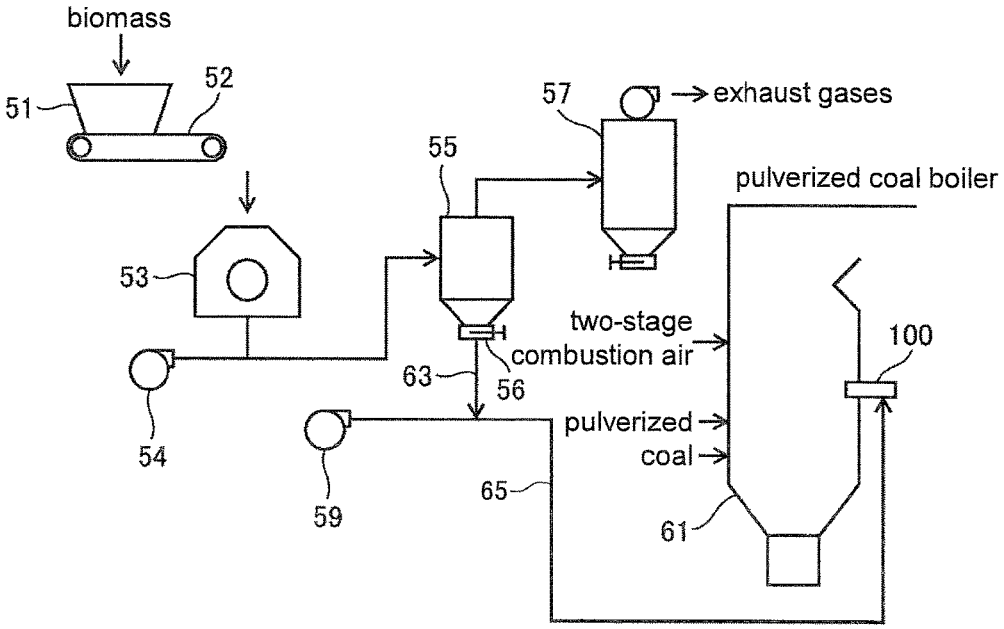
FIG. 3 is a plant system diagram illustrating a biomass burning process according to the embodiment.

FIG. 3 is a plant system diagram illustrating an exemplary biomass fuel supply system in a pulverized coal fired boiler to which the biomass combustion burner 100 according to the embodiment is applied.

The biomass combustion burner 100 is disposed on a side wall of a conventional pulverized coal fired boiler 61. The biomass combustion burner 100 may be installed in place of part of existing pulverized coal burners or two-stage combustion air supply nozzles.

Biomass fuel is processed by a dedicated pulverizing mill different from that which produces pulverized coal into granular particles having a grain size different from that of the pulverized coal, and supplied to the biomass combustion burner 100 by being conveyed by an air stream independently of the pulverized coal.

The biomass fuel supply system includes a receiving hopper 51, a belt conveyor 52, a pulverizing mill 53, a blower fan 54, a cyclone 55, a bag filter 57, a metering supplier 56, and a conveying fan 59. The receiving hopper 51 receives woody biomass material. The belt conveyor 52 unloads a predetermined amount of material from a bottom of the receiving hopper 51. The pulverizing mill 53 receives the material from the conveyor 52 and pulverizes the material into particles having a predetermined size. The blower fan 54 supplies air for conveying biomass fuel from the pulverizing mill 53. The cyclone 55 removes particulates from the biomass particles. The bag filter 57 removes fine powder from air discharged from the cyclone 55 and releases clean air into the atmosphere. The metering supplier 56 meters a predetermined amount of woody biomass fuel from a bottom of the cyclone 55. The conveying fan 59 supplies primary air for conveying the biomass fuel supplied at a predetermined flow rate.

The woody biomass material supplied to the receiving hopper 51 following primary pulverization undergoes secondary pulverization by the pulverizing mill 53 until the material has a predetermined grain size distribution. Blown by air to the cyclone 55 and with particulates removed, the material accumulates on the bottom of the cyclone 55 and is then metered by the metering supplier 56, so that a predetermined amount of material each is supplied to a biomass fuel supply pipe 63.

The biomass fuel supplied from the metering supplier 56 to the biomass fuel supply pipe 63 is conveyed by primary air sent under pressure from the conveying fan 59 and supplied to the biomass combustion burner 100 via a fuel conveying stream supply pipe 65.

A conveying air supply rate is determined so as to have a flow velocity of from 15 m/s to 25 m/s such that fuel particles do not stagnate or an excessively high speed stream does not occur in the fuel conveying stream supply pipe 65 or the biomass combustion burner 100.

Figure 4:
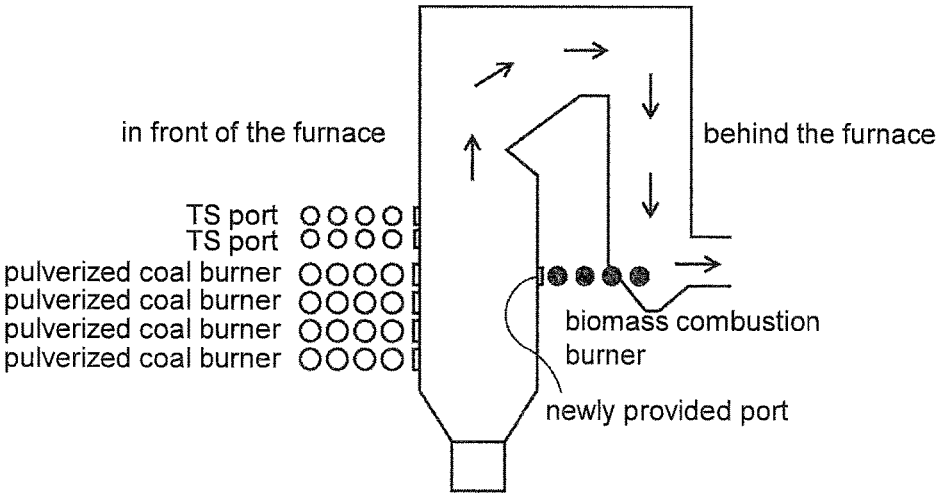
FIG. 4 is a conceptual diagram showing an exemplary disposition of the biomass combustion burner according to the embodiment in a boiler.

FIG. 4 is a diagram showing an exemplary disposition of the biomass combustion burner according to the embodiment in an existing pulverized coal-fired boiler.

In the exemplary disposition shown in FIG. 4, four biomass combustion burners arranged in one row are installed as adjuncts to the existing pulverized coal-fired boiler that includes a total of 16 pulverized coal burners, four each arranged in four rows, at lower portions in front of the furnace (upstream in a combustion gas stream), and a total of eight TS ports, four each arranged in two rows, at upper portions in front of the furnace (downstream in the combustion gas stream). The four biomass combustion burners are disposed at backside of the coal-fired boiler (behind the furnace) on a level substantially corresponding to a level of the pulverized coal burners on the uppermost row. The number of biomass combustion burners can be determined according to the capacity of the biomass combustion burner and the amount of biomass fuel to be processed by the boiler.

It is thus preferable that the pulverized coal burner is disposed under the biomass combustion burner, so that heavy fuel particles with large particle diameters contained in the biomass fuel are kept in suspension for combustion for an appropriate period of time by an updraft of the combustion gas. This prevents the heavy fuel particles with large particle diameters contained in the biomass fuel and in an unburned state from falling down onto the bottom of the furnace.

When an existing boiler is to be modified, understandably, any appropriate part of the existing pulverized coal burners or TS ports may be replaced with the biomass combustion burners.

The conventional pulverized coal burner generally requires that coal should be pulverized in order to enhance combustion efficiency, the coal being typically pulverized into fine particles of commonly 200 μm or less, preferably about 70 μm, for use with the conventional pulverized coal burner. The pulverized coal burner according to the embodiment uses pulverized coal fuel that has been processed such that fuel particle diameters of 74 μm or less account for 80%. By adjusting A/C (a ratio of fuel conveying air flow rate ($Nm^3/h$) to fuel (kg/h)) to fall within a range of 0.8 to 3.0, the pulverized coal can be burned such that a load factor to a rated value falls within a range of 35% to 100%.

However, when the material for the woody biomass fuel is pulverized, electric power for pulverization increases sharply at smaller grain sizes involved in pulverizing the material, thereby aggravating the economy. In addition, the woody biomass fuel is easier to burn than the coal for the same particle diameter, which allows the pulverized grain size to be made larger. As a result, preferably, the woody biomass fuel is pulverized to a grain size distribution of substantially 2 mm or under.

Because of the different optimum combustion conditions as described above, the embodiment uses the biomass combustion burner 100, rather than the pulverized coal burner, to burn the biomass fuel under conditions different from those for the pulverized coal. Thus, the embodiment uses the pulverizing mill 53 of a type selected independently of the pulverizing mill for the pulverized coal, for example, TSX Type Shredder manufactured by EarthTechnica Co., Ltd., to subject the woody biomass material supplied as primarily pulverized to the secondary pulverization to thereby form particles having a size most suitable for biomass combustion. For the primary air for conveyance, too, preferably, the independent conveying fan 59 is used to provide an air flow rate and air pressure suitable for the biomass combustion burner 100.

Figure 5:
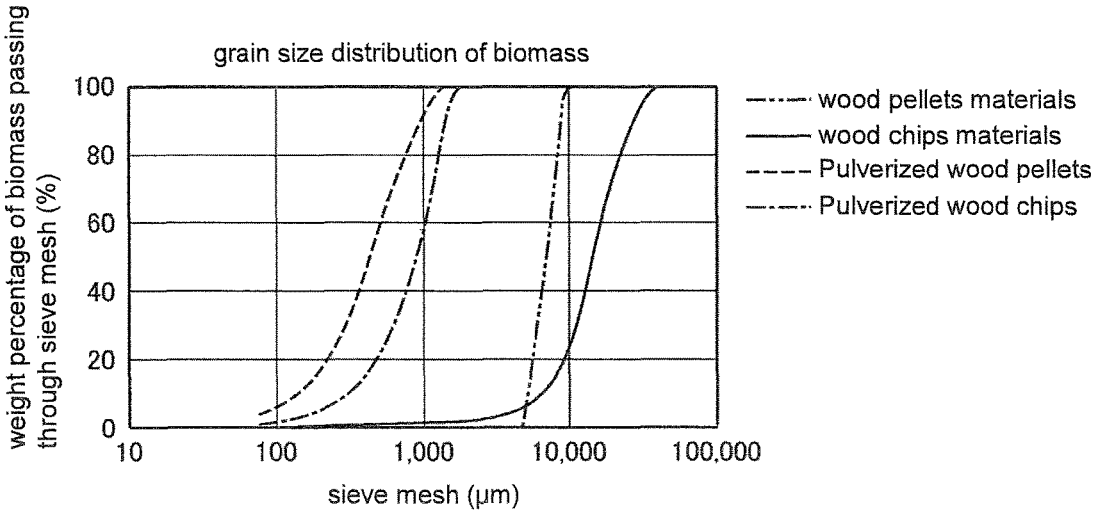
FIG. 5 is a grain size distribution diagram of biomass fuel supplied to the biomass combustion burner according to the embodiment.

FIG. 5 is a graph showing grain size distributions of woody biomass materials of wood pellets and wood chips before and after the processing performed by the pulverizing mill. For example, the wood pellets pulverized to 2 mm or under by the pulverizing mill 53 exhibit a grain size distribution with 700 μm or less accounting for 80% and can be reductively burned easily by the biomass combustion burner 100 according to the embodiment.

In addition, a thermohydraulic analysis of the woody biomass applied to an actual boiler has been performed to testify that the biomass fuel exhibiting the above-described grain size distribution undergoes combustion with its all particles being conveyed in suspension by a combustion gas updraft in the furnace when released thereinto from the fuel jet port 19 in the biomass fuel jet nozzle 10, leaving no unburned components subsiding at the bottom of the furnace.

Figure 6:
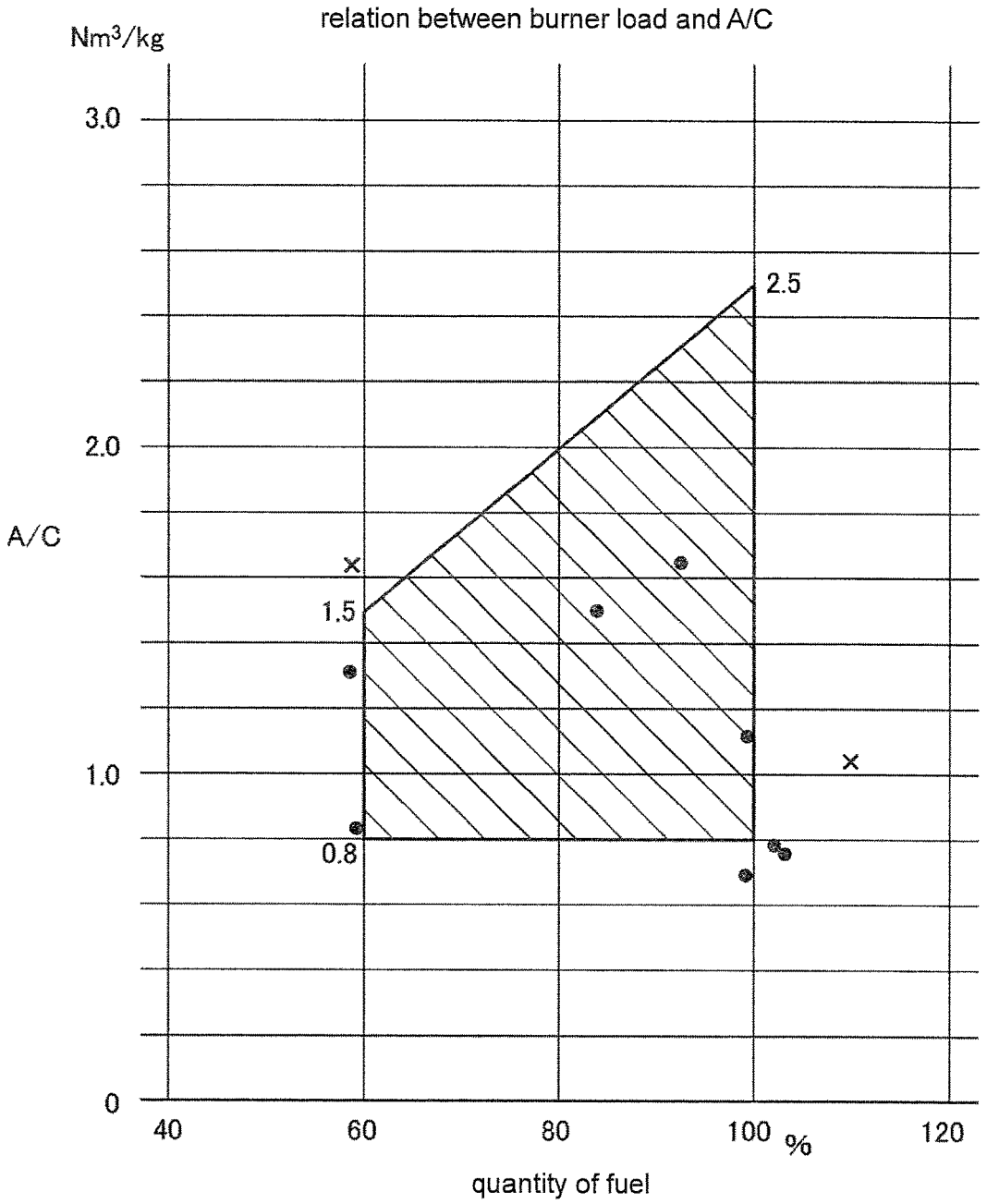
FIG. 6 is a diagram showing a relation between burner load and A/C representing an operating range of the biomass combustion burner according to the embodiment.
Figure 7:
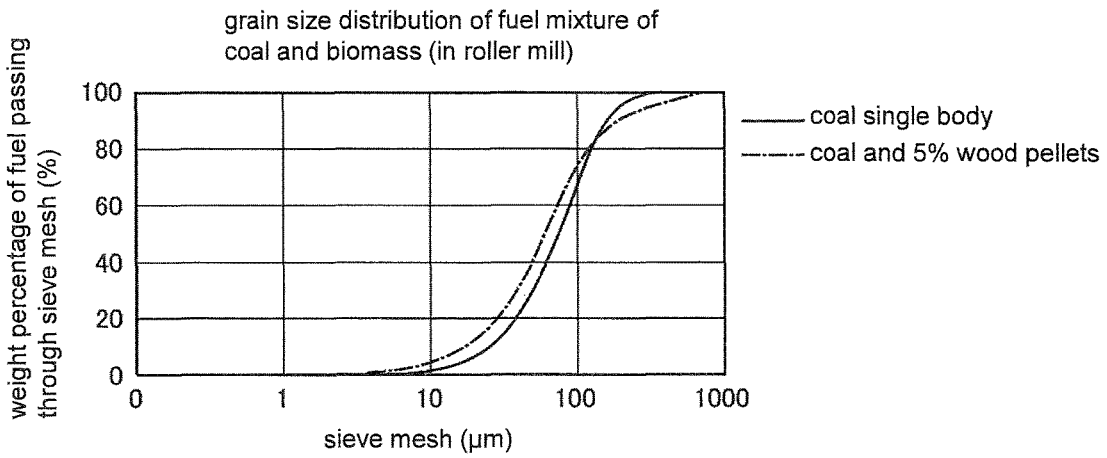
FIG. 7 is a grain size distribution diagram of a fuel mixture of coal and biomass burned in a conventional pulverized coal burner.

FIG. 6 is a diagram showing a relation between burner load and A/C of the biomass combustion burner 100 according to the embodiment. On the figure, the abscissa represents quantity of fuel in percentage (%) relative to rating and the ordinate represents A/C ($Nm^3/h$). The shaded area in the figure is a recommended zone for operation.

As shown in FIG. 6, the biomass combustion burner 100 according to the embodiment is industrially applicable in the range of A/C between 0.8 and 2.5 at a load factor of 100% and the range of A/C between 0.8 and 1.5 at a load factor of 60%.

While being usable up to a high A/C at a load factor of 100%, the biomass combustion burner 100 becomes disabled with smaller A/C at a load factor of 60%. This is considered to be attributable to the following reasons. Specifically, ignitability and flame holding performance are degraded due to decrease in fuel components in the fuel stream and the amount of primary air required for conveyance of the fuel does not change very much despite reduction in the amount of air for combustion as a result of reduced fuel. The resultant short supply of the secondary air and tertiary air decreases the flame holding action unique to the present burner mechanism.

At a load factor of 60% or less, the ratio of the fuel component in the biomass fuel stream is too small, making it difficult to achieve good ignition and flame stability. Thus, such a load factor is not recommended.

FIG. 6 shows results of an operable range checked using a biomass combustion burner capable of burning fuel with a rating of 300 kg/h. In the figure, the black dots denote cases with a steady flame exhibiting favorable ignitability and flame holding performance, while the x marks denote cases of inferior combustion exhibiting poor flame holding performance and the like. The figure testifies operability in the recommended operation zone.

The biomass-mixed fired boiler to which the biomass combustion burner of the embodiment is applied burns a large volume of woody biomass fuel to thereby save coal consumption and reduce the amount of CO2 emissions derived from fossil fuels. The biomass combustion burner burns the biomass fuel independently of the pulverized coal. This allows the combustion volume to be adjusted according to the number of installations. Thus, by installing an appropriate number of burners each having a predetermined capacity, a large volume of biomass fuel can be steadily co-fired.

Additionally, because the biomass fuel contains low nitrogen content, the biomass-mixed fired boiler can achieve reduction in NOx in the combustion exhaust gases.

INDUSTRIAL APPLICABILITY

A biomass-mixed fired boiler capable of combustion at a high mixed fuel burning ratio of biomass can be provided by applying the biomass combustion burner according to the present invention to a new or existing pulverized coal-fired boiler.

DESCRIPTION OF REFERENCE NUMERALS

10: biomass fuel jet nozzle
11: biomass fuel supply pipe
12: introduction pipe
13: reversal plate
15: fuel concentration adjusting section
16: swirler
17: degree-of-swirl adjusting plate
19: fuel jet port
20: secondary air nozzle
21: swirl vane
23: secondary air jet port
25: tertiary air nozzle
26: swirl vane
27: tertiary air jet port
31: auxiliary fuel supply pipe
51: receiving hopper
52: belt conveyor
53: pulverizing mill
54: blower fan
55: cyclone
56: metering supplier
57: bag filter
59: conveying fan
61: pulverized coal fired boiler
63: biomass fuel supply pipe
65: fuel conveying stream supply pipe
100: biomass combustion burner

The invention claimed is:

1. A method for burning biomass fuel, comprising:

burning biomass fuel using a biomass combustion burner, the biomass combustion burner comprising:

a biomass fuel jet nozzle having a bent section and a fuel jet port that jets biomass fuel conveyed by primary air;

a secondary air nozzle having a secondary air jet port that surrounds an opening in the fuel jet port, the secondary air nozzle jetting secondary air; and a tertiary air nozzle having a tertiary air jet port that surrounds the secondary air jet port, the tertiary air nozzle jetting a swirl flow of tertiary air, wherein the biomass combustion burner includes a swirler disposed at a center inside the biomass fuel jet nozzle, the swirler changing a biomass fuel stream drifted by the bent section into an axially whirling swirl flow to thereby make a fuel concentration lower on a pipe axis side and higher on an outer circumferential portion side, and includes a degree-of-swirl adjusting plate disposed on a pipe inner wall immediately upstream of the fuel jet port, the degree-of-swirl adjusting plate reducing a degree of swirl of the fuel stream that jets from the fuel jet port, thereby optimizing a fuel concentration distribution, the fuel jet port has a funnel-shape that widens the biomass fuel stream outwardly, the secondary air jet port has a funnel-shape that widens a secondary air stream outwardly, the secondary air jet port is disposed upstream of the fuel jet port, an opening in the secondary air jet port and an opening in the tertiary air jet port are adjusted to reduce an amount of the secondary air and a buffer stream is thereby formed between the fuel stream and a tertiary air stream, the biomass fuel is burned by supplying the biomass combustion burner with a fuel stream that contains woody biomass fuel exhibiting a grain size distribution of 2 mm or under, the woody biomass fuel being conveyed by the primary air such that fuel conveying air including the primary air has an A/C value that is: not less than 0.8, and not greater than proportional distribution between A/C 2.5 in a quantity of fuel of burner rating and A/C 1.5 in a quantity of fuel of 60% of the burner rating, and the A/C value is a ratio of fuel conveying air flow rate ($Nm^3/h$) to fuel (kg/h), the fuel conveying air being equal to the primary air.

2. The method for burning biomass fuel according to claim 1, wherein the primary air is supplied in such a quantity as to result in a velocity of a fuel conveying stream in the pipe of the biomass fuel jet nozzle falling within a range of from 15 m/s to 25 m/s.

* * * * *